US008305389B2

(12) United States Patent
Ahn et al.

(10) Patent No.: US 8,305,389 B2
(45) Date of Patent: Nov. 6, 2012

(54) APPARATUS AND METHOD FOR SIMULATING VIDEO DATA OF LIQUID CRYSTAL DISPLAY DEVICE

(75) Inventors: Ji Young Ahn, Anyang-si (KR); Dong Woo Kang, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 537 days.

(21) Appl. No.: 12/630,176

(22) Filed: Dec. 3, 2009

(65) Prior Publication Data

US 2010/0156925 A1 Jun. 24, 2010

(30) Foreign Application Priority Data

Dec. 24, 2008 (KR) ..... P2008-133509

(51) Int. Cl.
*G09G 5/02* (2006.01)

(52) U.S. Cl. ..... 345/589; 345/690

(58) Field of Classification Search ..... 345/589–605, 345/690–699

See application file for complete search history.

(56) References Cited

U.S. PATENT DOCUMENTS

| | | | | |
|---|---|---|---|---|
| 6,504,551 | B1 * | 1/2003 | Takashima et al. | 345/649 |
| 6,611,249 | B1 * | 8/2003 | Evanicky et al. | 345/102 |
| 2007/0001710 | A1 * | 1/2007 | Park et al. | 324/770 |

* cited by examiner

*Primary Examiner* — Xiao M. Wu
*Assistant Examiner* — Charles Tseng
(74) *Attorney, Agent, or Firm* — Brinks Hofer Gilson & Lione

(57) ABSTRACT

A method and apparatus for simulating video data of a liquid crystal display (LCD) device is disclosed. The simulation method includes providing voltage-versus-transmittance data and viewing angle-versus-transmittance data, which vary with a liquid crystal mode, using an optical simulation, converting the result of the optical simulation into a lookup table in connection with a viewing angle and an applied voltage, matching a driving voltage for gamma setting based on the liquid crystal driving mode to gray level data corresponding to the voltage-versus-transmittance data, and correcting minimum/maximum brightness levels, simulating a user-desired test image on a user interface screen; and correcting a color of data of a test image according to properties of an output panel, and finally displaying the color-corrected image.

12 Claims, 8 Drawing Sheets

APPARATUS AND METHOD FOR SIMULATING VIDEO DATA OF LIQUID CRYSTAL DISPLAY DEVICE

This application claims the benefit of Korean Patent Application No. P2008-133509, filed on Dec. 24, 2008, which is hereby incorporated by reference as if fully set forth herein.

BACKGROUND

1. Field of the Disclosure

The present disclosure relates to a simulator for a liquid crystal display (LCD) device, and more particularly to a method and apparatus for simulating an image or video data of the liquid crystal display (LCD) device so as to analyze characteristics of the LCD device before developing a product of the LCD device.

2. Discussion of the Related Art

Liquid crystal display (LCD) devices display video data or an image using electrical and optical properties of liquid crystals. This can be achieved by the anisotropic properties of liquid crystals exhibited in longer and shorter-axis directions of liquid crystal molecules in terms of physical values, such as refractive index and dielectric constant, and the advantage of liquid crystals that the molecular orientation and optical properties of liquid crystals can be easily controlled. In other words, LCD devices display an image by changing the orientation direction of liquid crystal molecules, and thus, controlling a transmittance of light passing through a polarizing plate. The LCD device includes a liquid crystal panel in which a plurality of pixels are arranged in the form of a matrix, and a driving circuit for driving the liquid crystal panel, and a backlight unit for emitting light on the liquid crystal panel.

Generally, in order to analyze or investigate electro-optical properties based on design parameters of the liquid crystal panel at a stage for developing a product of the LCD device, an optical simulator for the LCD device can be used. An optical simulator of the related art converts optical data based on design parameters of the liquid crystal panel into RGB data, and provides electro-optical properties as a value or graph format, such that only an optical simulation can be made available for the LCD device.

However, the video quality of the LCD device may be affected by other components (e.g., a backlight, a color filter, a polarizing plate) and a unique specification of the liquid crystal panel, such that it may be difficult to predict properties of the LCD device using only the optical simulation. Also, the entire mechanical, panel, circuit, and physical properties of the LCD device cannot be reflected in the optical simulator of the related art, and it is not possible for the optical simulator of the related art to perform video simulation for a multi-primary or a multi-mode. Also, properties of the output panel cannot be reflected in the optical simulator. So, if an image predicted at a product-developing stage is actually implemented, there may be a great difference between this predicted image and the actual output image of the LCD device.

SUMMARY

A method for simulating an image or video data of a liquid crystal display (LCD) device includes: providing voltage-versus-transmittance data and viewing angle-versus-transmittance data, which vary with a liquid crystal mode, using an optical simulation; converting the result of the optical simulation into a lookup table in connection with a viewing angle and an applied voltage; matching a driving voltage for gamma setting based on the liquid crystal driving mode to gray level data corresponding to the voltage-versus-transmittance data, and correcting minimum/maximum brightness levels; simulating a user-desired test image on a user interface screen; and correcting a color of data of a test image according to properties of an output panel, and finally displaying the color-corrected image.

The converting of the optical simulation result into the lookup table in connection with the viewing angle and the applied voltage may use not only each liquid crystal driving mode's transmittance indicating the optical simulation result, but also spectrums of user-selected color filter and backlight unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawing.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
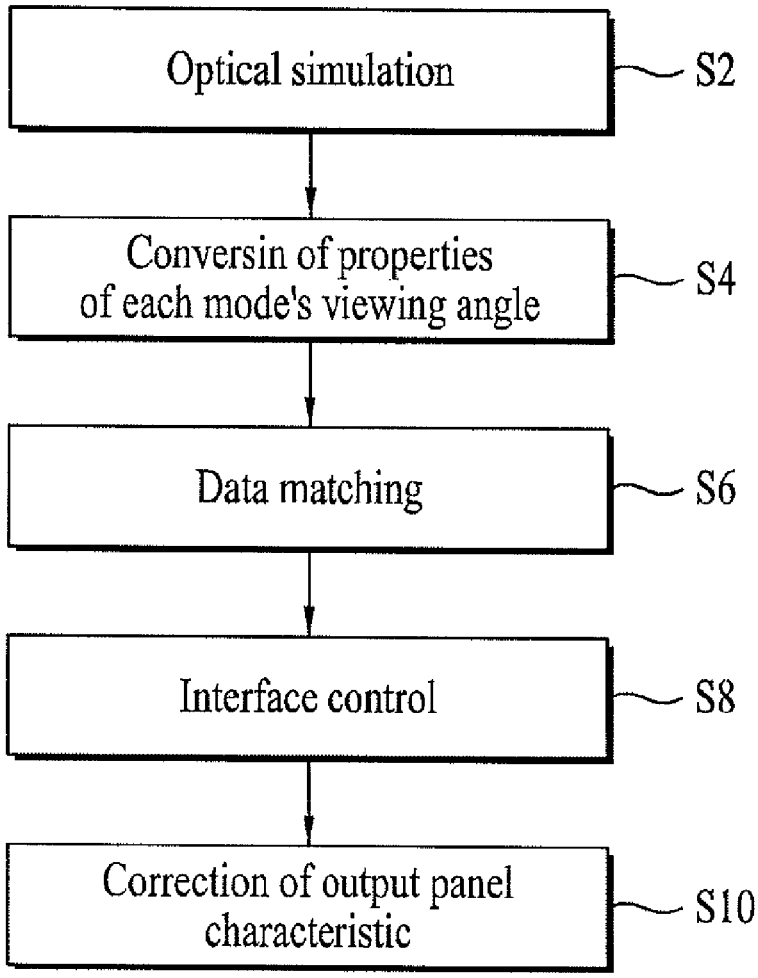
FIG. 1 is a flow chart illustrating a video simulation method for a liquid crystal display (LCD) device according to the present disclosure.

FIG. 1 is a flow chart illustrating a video simulation method for a liquid crystal display (LCD) device according to the present invention. The video simulation method shown in FIG. 1 is programmed and stored in a video simulator.

Figure 2A:
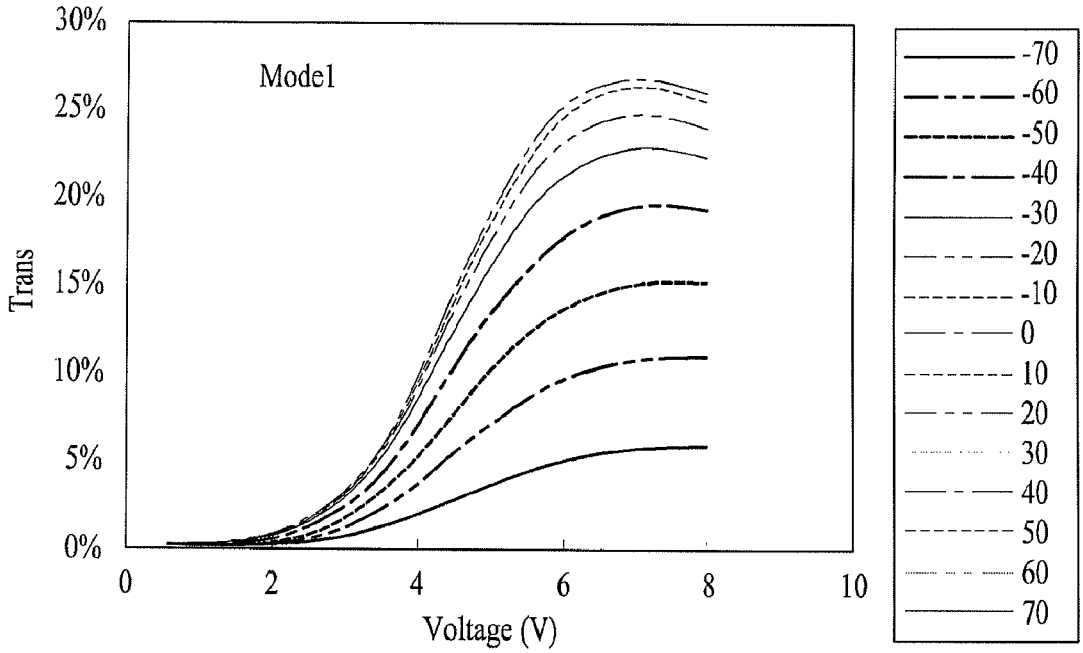
FIG. 2A is a graph illustrating a curve of voltage to a transmittance for each liquid crystal driving mode simulated by a video simulator.
Figure 2A:
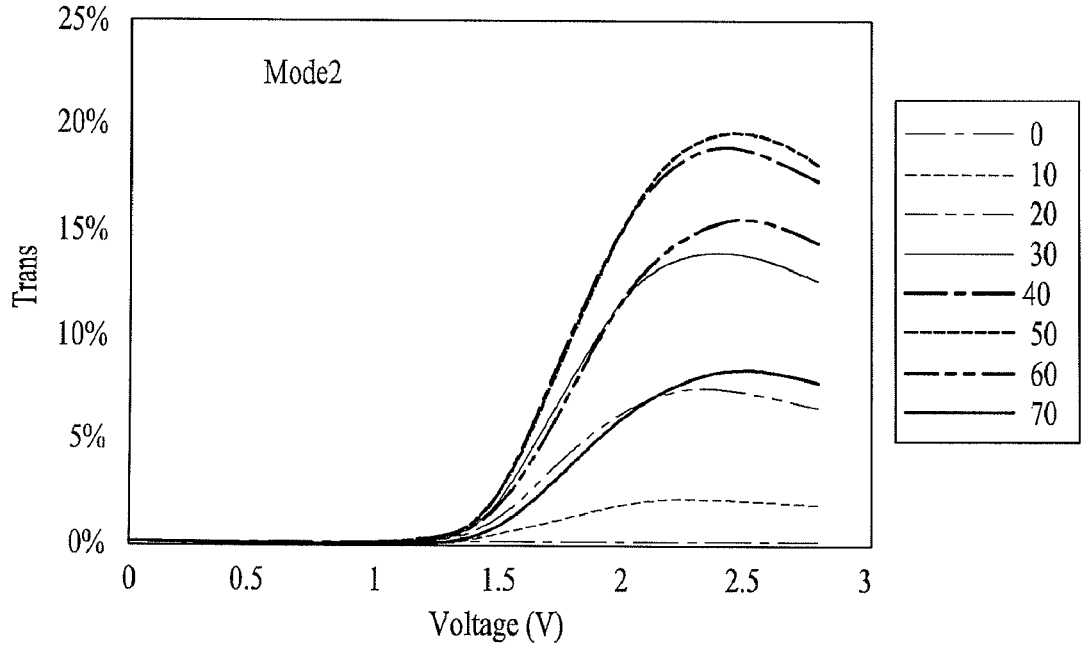
Figure 2B:
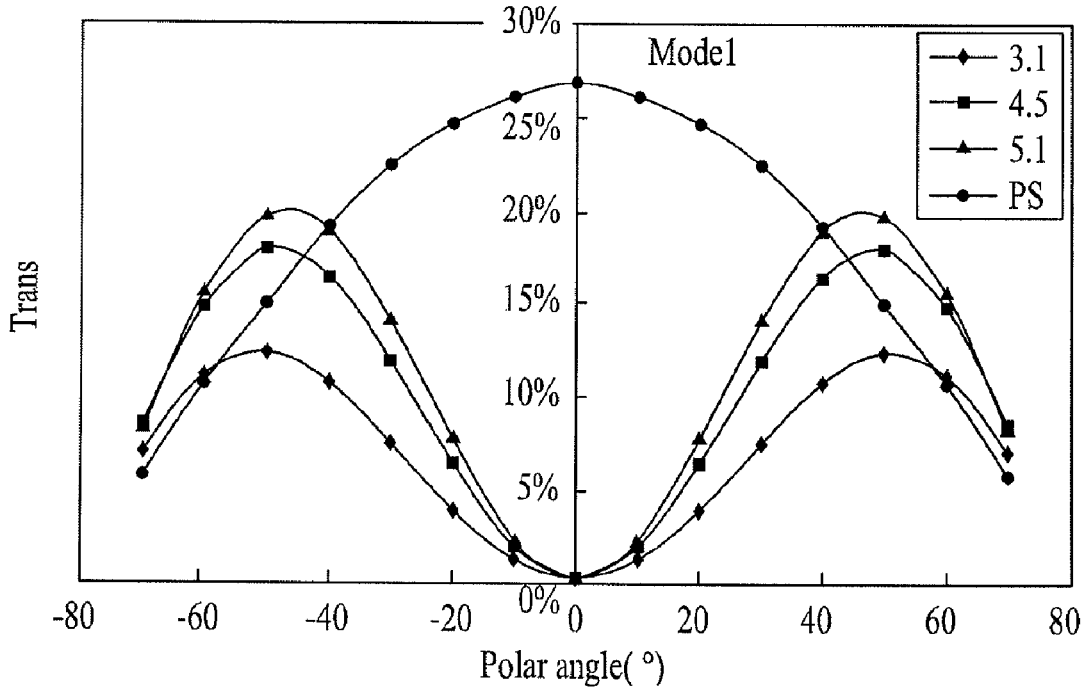
FIG. 2B is a graph illustrating a curve of a viewing angle to a transmittance for each liquid crystal driving mode.

At step S2, a video simulator according to the present invention provides a transmittance curve of a voltage based on a liquid crystal driving mode and another transmittance curve of a viewing angle using an optical simulation. For example, through the optical simulation, the video simulator provides transmittance curves of individual voltages of first and second liquid crystal driving modes (Mode1 and Mode2) as shown in FIG. 2A. As shown FIG. 2, the video simulator provides transmittance curves of individual viewing angles of the first and second driving modes (Mode1 and Mode2). For example, in association with a liquid crystal panel having an RGBW pixel structure and another liquid crystal panel having a multi-primary, the video simulator provides a transmittance curve of a voltage and another transmittance curve of a viewing angle.

At step S4, the video simulator receives the optical simulation result from the above step S2, and converts the received simulation result into a lookup table based on a viewing angle and an applied voltage. The video simulator converts viewing-angle characteristics of individual modes into other characteristics using not only each mode's transmittance indicating the optical simulation result but also color filter or backlight spectrums received from an external part. The video simulator calculates CIR-XYZ tristimulus values based on a viewing angle and an applied voltage using the transmittance for each mode and spectrums of the color filter and the backlight according to the following equation 1, such that it converts the CIE-XYZ tristimulus values into a two-dimensional lookup table in connection with the viewing angle and the applied voltage. In this case, the used simulation data, i.e., each spectrum of the color filter and the backlight, may be constructed in the form of a database.

$$X=K_m\int_{vis}x(\lambda)[T_R(\lambda,V_R)+T_G(\lambda,V_G)+T_B(\lambda,V_B)\cdot B(\lambda)d\lambda$$

$$Y=K_m\int_{vis}y(\lambda)[T_R(\lambda,V_R)+T_G(\lambda,V_G)+T_B(\lambda,V_B)\cdot B(\lambda)d\lambda$$

$$Z=K_m\int_{vis}z(\lambda)[T_R(\lambda,V_R)+T_G(\lambda,V_G)+T_B(\lambda,V_B)\cdot B(\lambda)d\lambda \quad \text{[Equation 1]}$$

In Equation 1, $B(\lambda)$ is a spectrum brightness, $T(\lambda,V)$ is each transmittance of R/G/B color filters, and $x(\lambda)/y(\lambda)/z(\lambda)$ are tristimulus values.

Figure 3A:
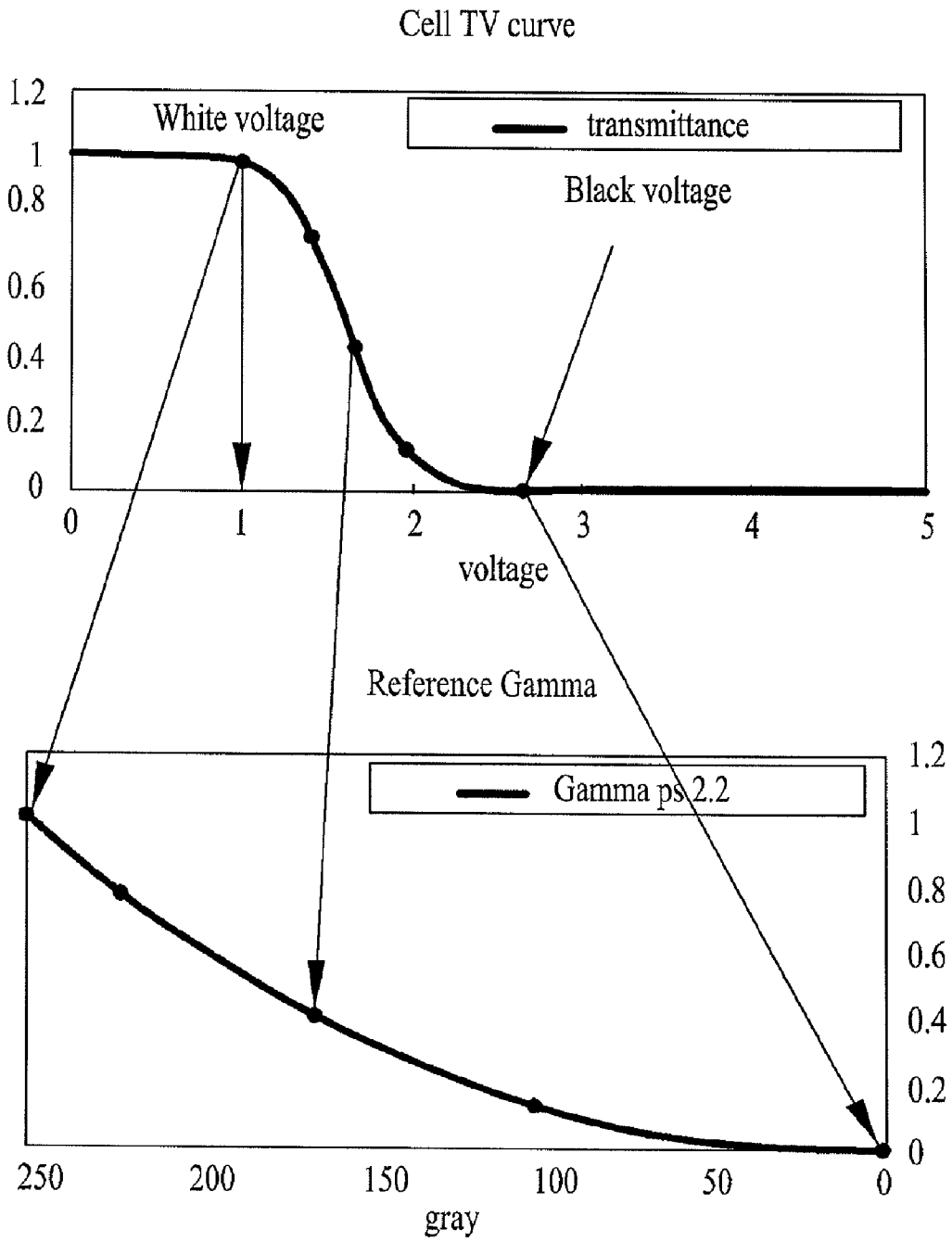
FIG. 3A shows a data matching method for a gamma setting provided from a video simulator.
Figure 3B:
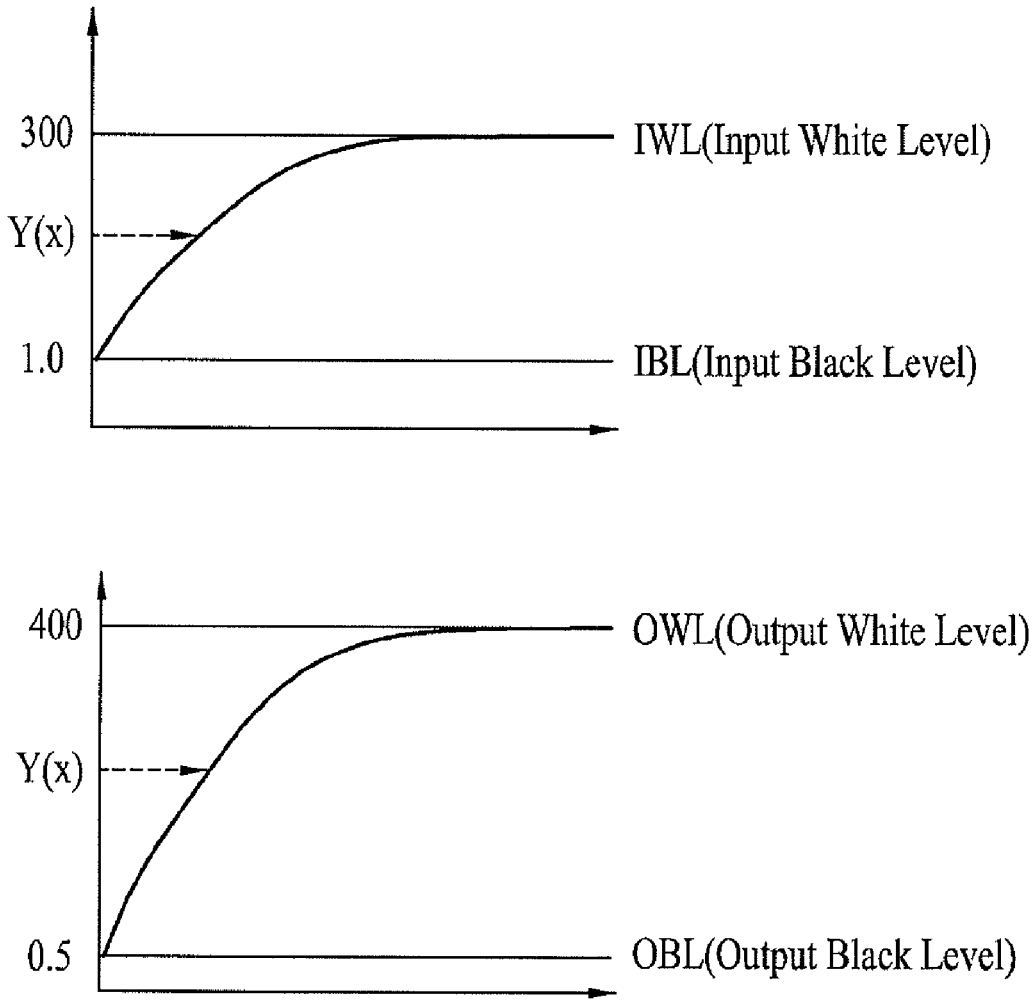
FIG. 3B shows a brightness matching method.

At step S6, the video simulator performs setting of gamma and brightness values based on a liquid crystal driving mode using a data matching process. In other words, in order to perform setting of the gamma value based on the liquid crystal mode, the video simulator matches the gamma value to either R/G/B data or R/G/B/W data corresponding to the curve of voltage versus transmittance, and at the same time corrects minimum/maximum brightness levels according to a brightness setting of the LCD device. For example, as shown in FIG. 3A, a voltage-versus-transmittance curve is matched to R/G/B data in order to accomplish the gamma setting. As shown in FIG. 3B, the video simulator corrects input minimum/maximum (black/white) brightness levels according to a brightness setting of the LCD device, and provides minimum/maximum (black/white) brightness levels according to the corrected result.

The video simulator performs modeling of the liquid crystal panel at steps S2~S6.

Figure 4A:
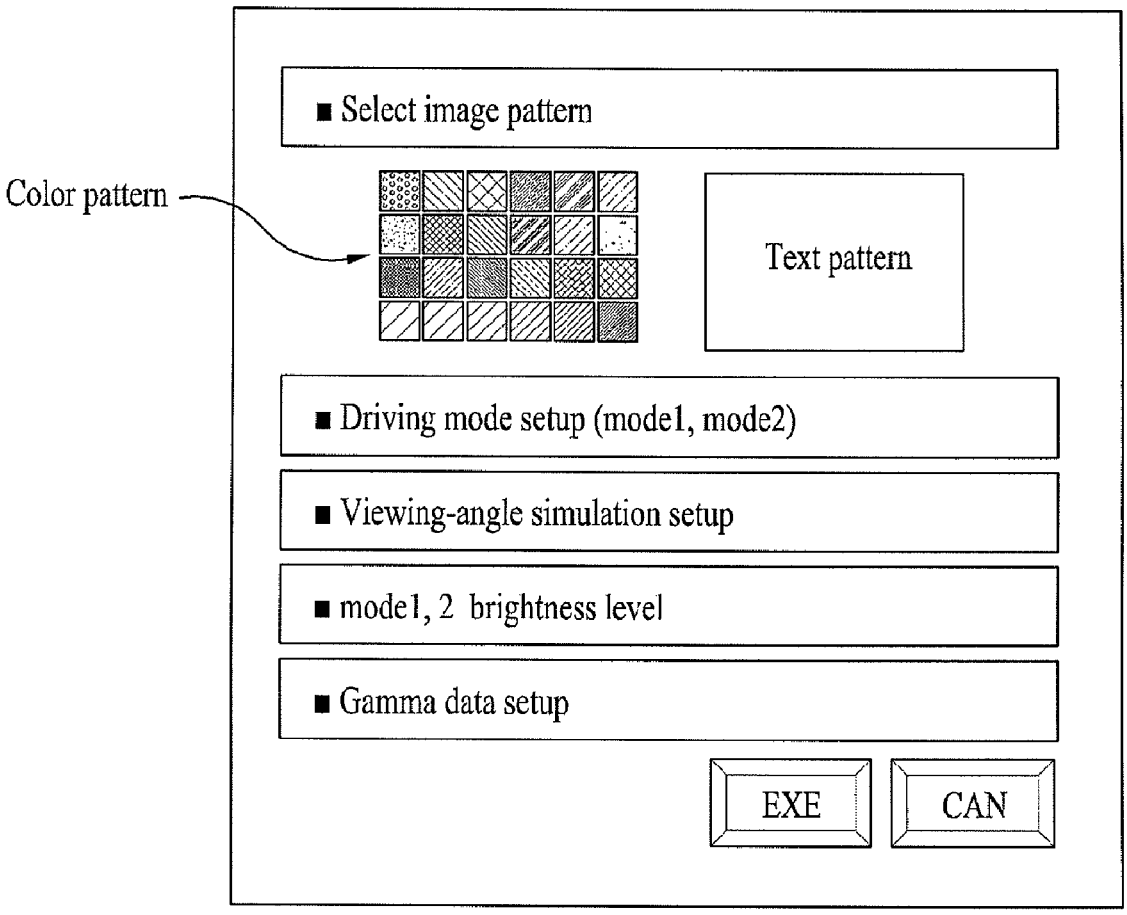
FIG. 4A shows a user interface screen provided from a video simulator.
Figure 4B:
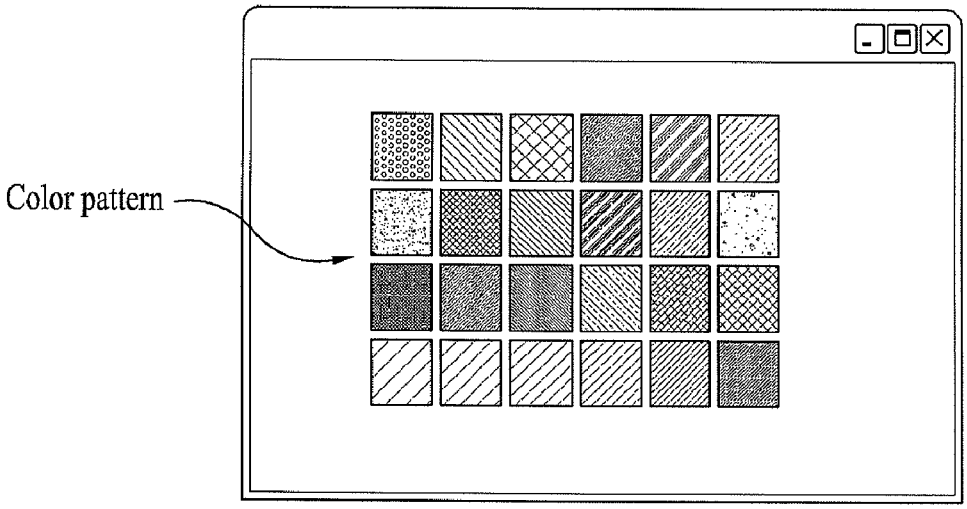
FIG. 4B shows a test image being simulated.
Figure 4C:
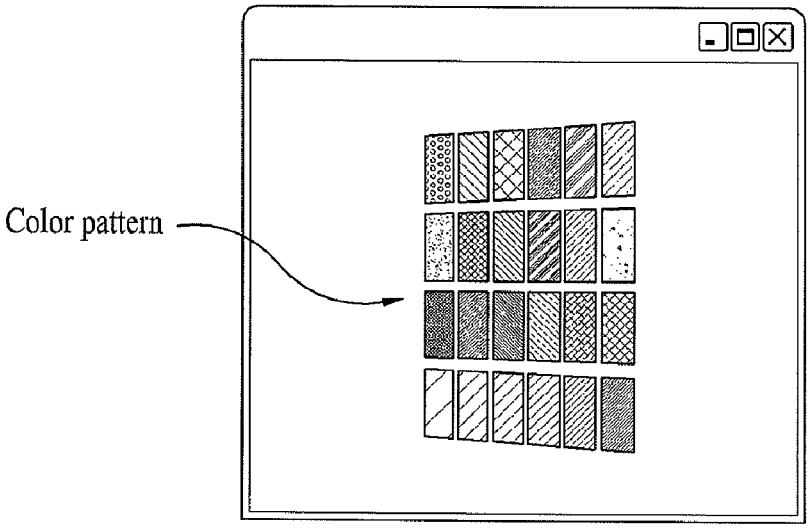
FIG. 4C shows a test image being simulated according to individual viewing angles.

At step S8, the video simulator simulates a test image selected by a user by controlling a user interface, such that it can analyze or investigate properties of a product modeled by the user (e.g., RGBW or multi-primary liquid crystal panels). In this case, the user selects a test image to be simulated through a user interface window (See FIG. 4A) displayed on the video simulator, and directly establishes a brightness level and gamma data according to a driving mode, such that the test image selected by the user can be simulated as shown in FIG. 4B. As shown in FIG. 4C, the user-selected test image may be differently simulated according to individual viewing angles. Also, the user-selected test image and patterns such as characters for security setting are simulated at the same time, and the simulated result is differently displayed according to individual viewing angles. As a result, a liquid crystal display (LCD) device for special purposes such as the security setting can be simulated. In this case, the above-mentioned LCD device for the security setting is able to provide a narrow-viewing-angle control function to guarantee personal confidentiality.

At step S10, the video simulator converts data into another data according to properties of the output panel, and outputs the final image according to the converted result. Thus, since an output panel independently performs a color mapping according to individual properties of RGB-type liquid crystal panel, RGBW-type liquid crystal panel, and multi-primary liquid crystal panel, the video simulator is able to simulate the final image corresponding to the liquid crystal panel type. For this purpose, the video simulator converts RGB data of the test image to be outputted into CIE-XYZ tristimulus values by referring to the gamma lookup table of the LCD device. The video simulator outputs the CIE-XYZ tristimulus values to linear XYZ data appropriate for the output device by referring to the following equation 2, and outputs the final image according to the linear RGB data.

$$[R\ G\ B]^T = M^{-1}\cdot[X\ Y\ Z]^T \quad \text{[Equation 2]}$$

$$M^{-1} = \begin{bmatrix} RX'[255] & RY'[255] & RZ'[255] \\ GX'[255] & GY'[255] & GZ'[255] \\ BX'[255] & BY'[255] & BZ'[255] \end{bmatrix}^{-1}$$

Figure 5:
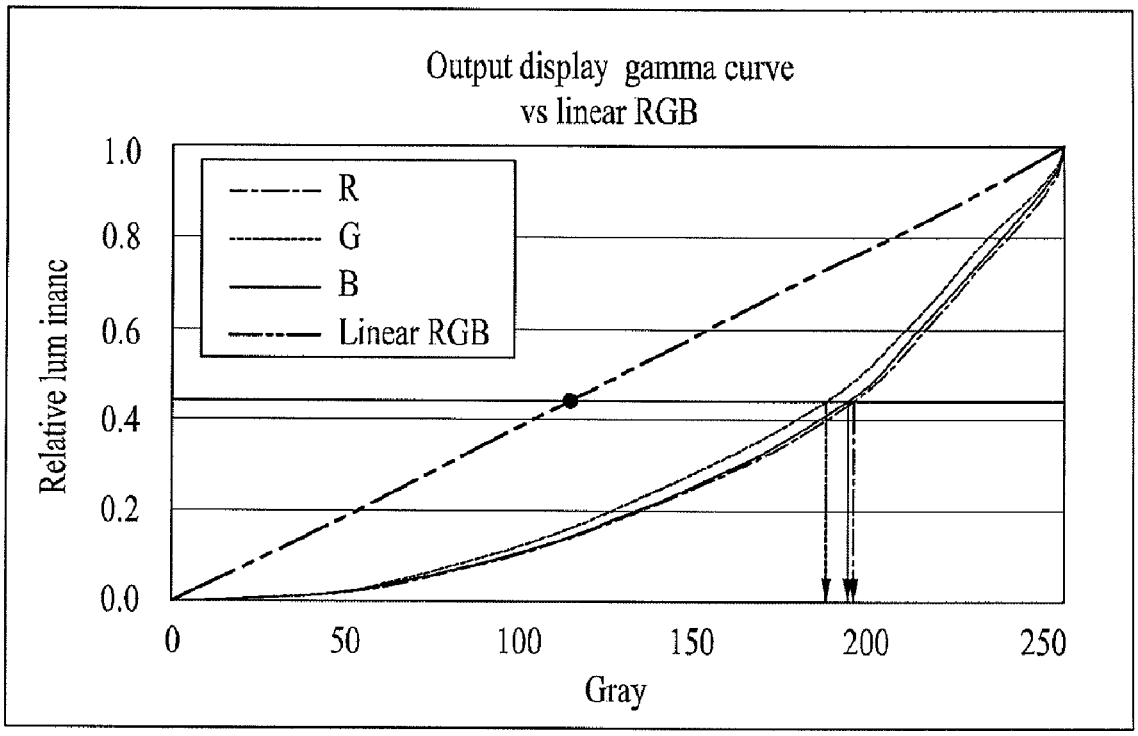
FIG. 5 shows a method for correcting gamma properties of an output panel.

Also, in order to correct abnormal gamma characteristics of the output panel, the video simulator normalizes the gamma value of the output panel on the basis of the following equation 3 as shown in FIG. 5, and converts the normalized result into digital RGB data corresponding to the linear RGB data, such that it outputs the final image according to the converted result.

R_gamma[0:255]=RY'[0:255]/RY[255]

G_gamma[0:255]=GY'[0:255]/GY[255]

B_gamma[0:255]=BY'[0:255]/BY[255] [Equation 3]

As described above, the method and apparatus for simulating video data of the LCD device according to the present invention may include a specific algorithm for modeling a panel manufacturing process of the LCD device. Also, the above-mentioned simulation method and apparatus may include a color mapping method for independently simulating the final output result according to the type of an output panel. Also, the above-mentioned simulation method and apparatus may provide an interface which can allow a user to directly adjust other physical variables (e.g., a viewing angle, gamma, brightness, and a liquid crystal mode). Therefore, in the case where constituent elements of the output panel and an algorithm applied to this output panel are changed to others prior to the development of a manufactured product of the output panel which requires a security setup or has various properties such as RGB/RGBW/multi-primary types, the present invention may allow the user to investigate properties of the LCD device to be manufactured using only a software simulation at a product design stage. As a result, the present invention can reduce time and cost needed for developing a new product, and can also improve the efficiency of an optical program of the LCD device. In addition, the method and apparatus for simulating an image or video data of the LCD device can perform modeling of a circuit simultaneously while investigating various images on the basis of the optical simulation result or the measurement result. Further, the present invention can analyze properties of a model, properties of which should be contrasted with others.

As apparent from the above-mentioned description, the method and apparatus for simulating an image or video data of the LCD device according to the present invention can simulate the video data by reflecting all the panel/circuit/mechanical characteristics of the LCD device, may independently correct a test image according to properties of the output panel, and may then output the corrected image.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for simulating on a video simulator an image or video data of a liquid crystal display (LCD) device comprising:

providing voltage-versus-transmittance data and viewing angle-versus-transmittance data, which vary with a liquid crystal driving mode, using an optical simulation;

converting a result of the optical simulation into a lookup table in connection with a viewing angle and an applied voltage;

matching a driving voltage for gamma setting based on the liquid crystal driving mode to gray level data corresponding to the voltage-versus-transmittance data, and correcting minimum/maximum brightness levels;

simulating a user-desired test image on a user interface screen; and correcting a color of data of a test image according to properties of an output panel, and displaying the color-corrected image.

2. The method according to claim 1, wherein the converting of the optical simulation result into the lookup table in connection with the viewing angle and the applied voltage includes:

using each liquid crystal driving mode's transmittance indicating the optical simulation result and spectrums of user-selected color filter and backlight unit.

3. The method according to claim 1, further comprising:

allowing the user to adjust physical variables through the user interface screen.

4. The method according to claim 3 wherein the physical variables include at least one of: a viewing angle, gamma, brightness, and a liquid crystal driving mode.

5. The method according to claim 3, wherein the test image selected by the user and a test pattern selected for a security setup are simultaneously simulated through the user interface screen.

6. The method according to claim 3, wherein the user-selected test image is simulated according to each viewing angle.

7. An apparatus, comprising: a liquid crystal display (LCD) device, and a simulator modeling a manufacturing process of a liquid crystal panel and simulating a test image by implementing a video simulation method, the video simulation method comprising:

providing voltage-versus-transmittance data and viewing angle-versus-transmittance data, which vary with a liquid crystal driving mode, using an optical simulation;

converting a result of the optical simulation into a lookup table in connection with a viewing angle and an applied voltage;

matching a driving voltage for gamma setting based on the liquid crystal driving mode to gray level data corresponding to the voltage-versus-transmittance data, and correcting minimum/maximum brightness levels;

simulating a user-desired test image on a user interface screen; and correcting a color of data of a test image according to properties of an output panel, and displaying the color-corrected image.

8. The apparatus according to claim 7, wherein the converting of the optical simulation result into the lookup table in connection with the viewing angle and the applied voltage includes:

using each liquid crystal driving mode's transmittance indicating the optical simulation result and spectrums of user-selected color filter and backlight unit.

9. The apparatus according to claim 7, the video simulation method further comprising:

allowing the user to adjust physical variables through the user interface screen.

10. The apparatus according to claim 7 wherein the physical variables include at least one of: a viewing angle, gamma, brightness, and a liquid crystal driving mode.

11. The apparatus according to claim 9, wherein the test image selected by the user and a test pattern selected for a security setup are simultaneously simulated through the user interface screen.

12. The apparatus according to claim 9, wherein the user-selected test image is simulated according to each viewing angle.

* * * * *